United States Patent [19]

Bleibtreu et al.

[11] 3,935,407

[45] Jan. 27, 1976

[54] MULTIPHASE VACUUM SWITCH ASSEMBLY HAVING CAM OPERATED SPRING CHARGING DRIVE MECHANISM WITH LOST MOTION CONNECTION

[75] Inventors: Alexander Bleibtreu; Rolf Lauterwald, both of Regensburg, Germany

[73] Assignee: Maschinenfabrik Reinhausen Gebruder Scheubeck K.G., Regensburg, Germany

[22] Filed: Sept. 16, 1974

[21] Appl. No.: 506,063

[30] Foreign Application Priority Data

Sept. 25, 1973 Germany ..... 2348091

[52] U.S. Cl. ..... 200/144 B; 200/145; 200/153 V; 200/153 SC

[51] Int. Cl.[2] ..... H01H 33/42; H01H 3/32

[58] Field of Search.... 200/11 TC, 17 R, 18, 144 B, 200/145, 153 LB, 153 V, 153 SC

[56] References Cited

UNITED STATES PATENTS

| | | | |
|---|---|---|---|
| 3,418,439 | 12/1968 | Casey et al. | 200/153 V UX |
| 3,538,277 | 11/1970 | Phillips | 200/145 X |
| 3,632,933 | 1/1972 | McClain et al. | 200/153 SC |
| 3,663,770 | 5/1972 | Groskopfs | 200/11 R |
| 3,728,508 | 4/1973 | Netzel | 200/153 V |

*Primary Examiner*—Robert K. Schaefer
*Attorney, Agent, or Firm*—Erwin Salzer

[57] ABSTRACT

A multiphase under load transfer switch of the Jansen-type for tapped regulating transformers. The main contacts and the switch-over contacts of the transfer switch are formed by vacuum switches. The vacuum switches are operated by a common drive mechanism for all of the vacuum switches of all three phases of the transfer switch. The required sequence of the operation of the vacuum switches is achieved by interposition of lost motion connection means between said common drive mechanism and pairs of aligned operating rods for pairs of superimposed vacuum switches. A special common drive mechanism for said pairs of aligned operating rods for operating pairs of superimposed vacuum switches includes a squirrel-cage-like system of helical compression springs which are loaded by pivotable cam means and operate, when subsequently expanding, said pairs of vacuum-switch-operating rods by the intermediary lost motion connection timing means.

6 Claims, 17 Drawing Figures

FIG. 3
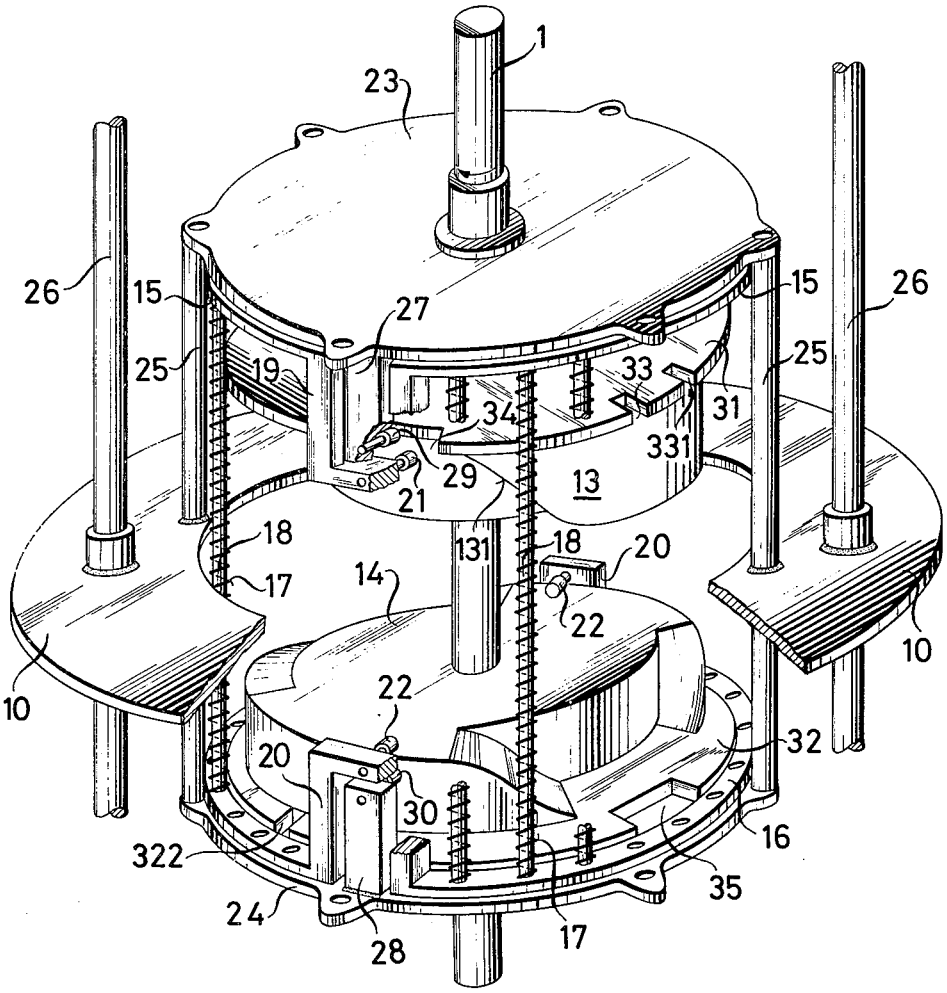
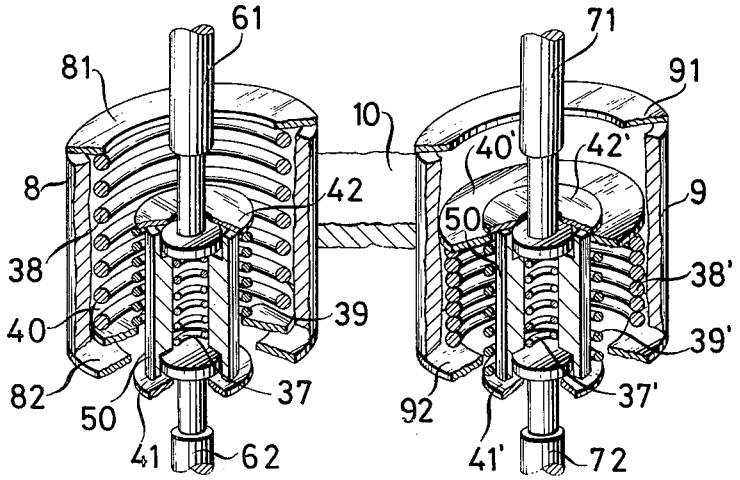
FIG. 4

MULTIPHASE VACUUM SWITCH ASSEMBLY HAVING CAM OPERATED SPRING CHARGING DRIVE MECHANISM WITH LOST MOTION CONNECTION

BACKGROUND OF THE INVENTION

This invention relates to load tap changers for tapped regulating transformers, and more particularly to load tap changers of the Jansen type. Such devices include a selector switch used to select a desired tap on a tapped transformer winding, and a transfer switch used to effect tap changes without complete interruptions of the flow of the load current. Selector switches do not make and break, and transfer switches make and break, energized electric circuits.

The invention relates more specifically to polyphase Jansen-type transfer switches as shown, for instance, in U.S. Pat. No. 3,396,254 to A. Bleibtreu, Aug. 6, 1968 for ARRANGEMENT FOR AVOIDING EDDY CURRENT LOSSES IN TRANSFER SWITCH AND SELECTOR SWITCH UNITS WITH INTERPOSED GEAR DRIVE.

It is known or prior art to substitute in Jansen-type transfer switches vacuum switches for the conventional main contacts and switch-over contacts thereof, the latter being shown, for instance, in the above referred-to patent. In these prior art switches the operating rods of the vacuum switches are operated by positive cam action.

A three phase transfer switch requires a total of 12 vacuum switches to function as main contacts and switch-over contacts, and tends to be extremely bulky and limited to low power applications. It is, therefore, one of the principal objects of the invention to arrange the constituent vacuum switches of a transfer switch in such a way as to minimize space requirements, and to provide the constituent vacuum switches of a transfer switch with common drive means, and to achieve the desired sequence of operations of the vacuum switches with extremely compact spring operated lost motion connection devices.

Another object of the present invention is to provide three phase transfer switches including 12 compactly arranged vacuum switch elements wherein the latter are arranged in such a way as to allow extremely simple wiring thereof.

Other objects of the invention will become apparent from what follows below:

SUMMARY OF THE INVENTION

A transfer switch embodying this invention includes 12 vacuum switches forming two groups each of six situated at two different levels. The constituent vacuum switches of each group are arranged in circular coaxial patterns. The vacuum switches in one of said levels are arranged in registry with the vacuum switches in the other of said levels. Transfer switches embodying this invention further include pairs of aligned operating rods movable in a direction longitudinally thereof arranged between registering pairs of vacuum switches at different levels for operating said pairs of vacuum switches at different levels. Transfer switched embodying this invention further include a drive mechanism having a common power driven element for said pairs of operating rods movable in the direction of the axis of said circular coaxial patterns in which the vacuum switches of the aforementioned two groups of vacuum switches are arranged. Said drive mechanism includes a drive shaft arranged along an axis defined by the centers of said two groups of vacuum switches. Transfer switches embodying this invention further include lost motion connection means interposed between said driving element of said drive mechanism and said pairs of aligned operating rods to impart predetermined sequences to the operation of said vacuum switches. A plurality of helical compression springs extends parallel to said drive shaft and is arranged generally in a cylindrical surface surrounding said drive shaft. The structure further includes cam means and abutment means both jointly pivotable with said drive shaft for loading and unloading said plurality of helical compression springs in response to predetermined angular motions of said drive shaft and allowing said plurality of helical compression springs to expand upon angular motions of said drive shaft in excess of said predetermined angular motions thereof. Transfer switches embodying this invention further include an annular driving element surrounding said drive shaft, operated by said plurality of helical compression springs and operating said lost motion connection means.

BRIEF DESCRIPTION OF THE DRAWINGS

FIG. 3 is an isometric view of the spring drive, or spring operated mechanism, for operating transfer switches embodying the present invention;

FIG. 4 shows the mechanical tie means for tying together two juxtaposed or registering vacuum switches;

DESCRIPTION OF PREFERRED EMBODIMENT

Figure 1:
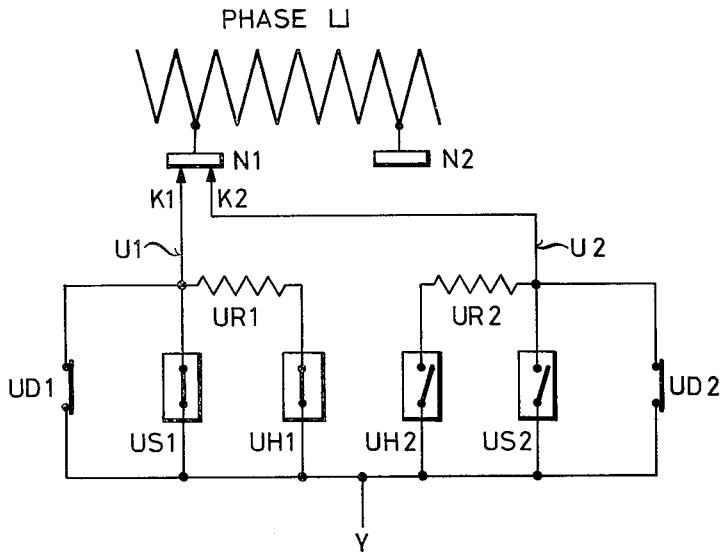
FIG. 1 is a circuit diagram showing the circuitry of one single phase of a three phase load transfer switch embodying the present invention.

As shown in FIG. 1, each phase of a transfer switch includes four vacuum switches US1,UH1 and US2-,UH2. Vacuum switches US1 and US2 are main vacuum switches, and vacuum switches UH1 and UH2 are auxiliary vacuum switches, or tap-changing switch-over vacuum switches. Vacuum switches US1 and US2 may be shunted by low resistance currentcarrying switches UD1 and UD2. The presence of switches UD1 and UD2 is optional rather than mandatory. Phase winding U of a transformer is provided with two taps N1 and N2. Selector contacts K1, K2 are shown to engage tap N1. Contacts K1, K2 are adapted to be moved from tap N1 into physical engagement with tap N2. In the stable conditions, i.e. when current is drawn from either of the two taps N1, N2 only, both selector contacts K1, K2 engage the same tap. This has been shown in FIG. 1 in regard to tap N1 and selector contacts K1, K2. During a switch-over operation, or tap-changing operation, contact K1 engages only tap N1, and contact K2 engage only tap N2. As soon as a tap-changing operation is completed, both selector contacts K1, K2 are brought into engagement with the same tap. To be more specific, when switching from tap N2 to tap N1, selector contact K2 is ultimately moved from tap N2 to tap N1, as shown in FIG. 1, i.e. when the tap-changing operation is completed and the load current is derived from tap N1 both contacts K1, K2 engage tap N1. When switching from tap N1 to tap N2, selector contact K1 is in engagement with tap N1 and selector contact K2 is in engagement with tap N2. When the tap-changing operation is completed and the load current is derived from tap N2 only, selector contact K1 parts from tap N1 and moves into engagement with tap N2. By virtue of this arrangement and mode of operation of selector contacts K1, K2, the voltage prevailing between taps N1, N2 is applied to the change-over switch or transfer switch only during periods of tap-changes.

Contact K1 is connected by lead U1 directly to vacuum switch US1, and by the same lead and the intermediary of switch-over resistor UR1 to vacuum switch UH1. In like fashion contact K2 is connected by lead U2 directly to vacuum switch US2, and by the same lead and the intermediary of switch-over resistor UR2 to vacuum switch UH2. Leads U1, U2 and resistor UR1, UR2 form part of the transformer side of the transfer switch circuitry. All contacts of switches US1, UH1, UH2, US2 remote from transformer winding are connected to the common line Y. This is also true as to the contacts of current-carrying switches UD1, UD2 shunted across switches US1 and US2.

Considering a tap change from tap N1 to tap N2, this operation involves the following sequential steps: Current carrying switch UD1 opens and contact K2 moves from tap N1 to tap N2; vacuum switch US1 opens; vacuum switch UH2 closes; vaccuum switch UH1 opens and vacuum switch US2 closes; current-carrying switch UD2 closes and contact K1 moves from tap N1 to tap N2. The sequence of operational steps of switches US1, UH1, UH2, US2 is prior art, and there are many prior art mechanisms to achieve the required sequence of switching steps. However, new means for achieving the required sequence of switching steps will be described below.

Figure 2:
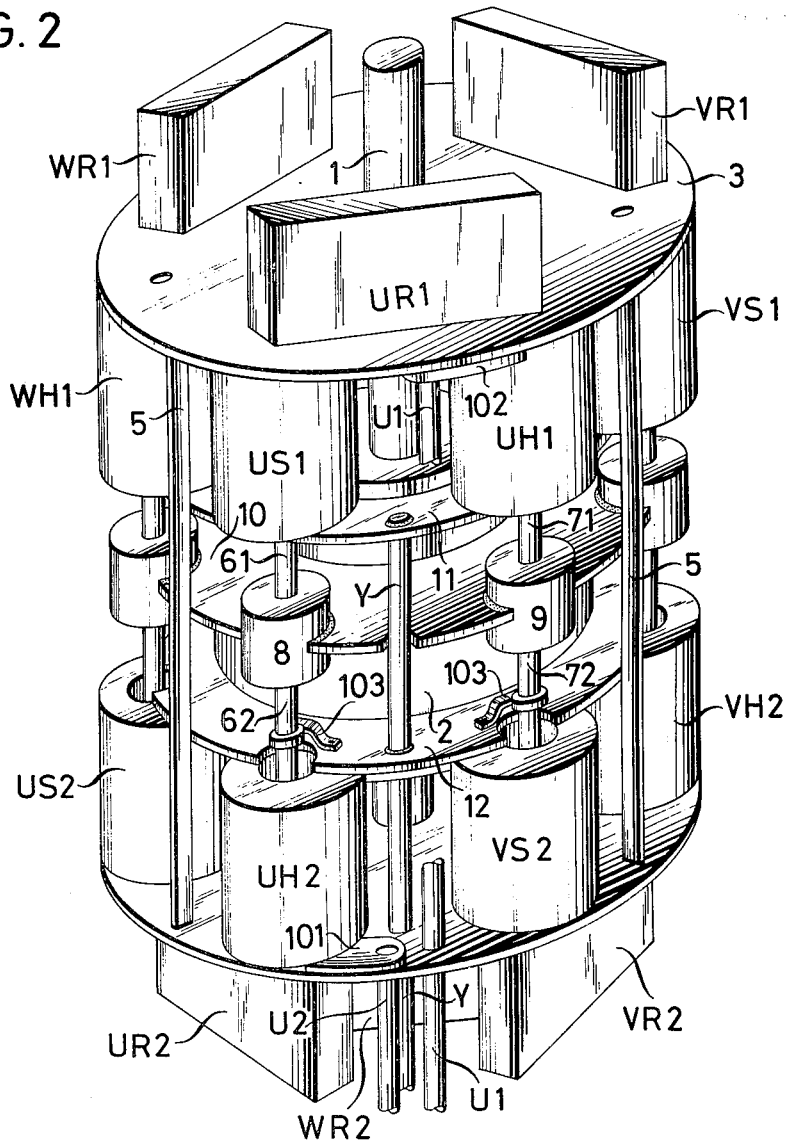
FIG. 2 is an isometric view of a three phase load transfer switch embodying the present invention.

Referring now to FIG. 2, the transfer switch shown therein includes 12 vacuum switches which are arranged in a cylindrical pattern in spaced parallel columns. FIG. 2 shows 8 of the aforementioned vacuum switches, the remaining four vacuum switches being covered up by those shown in FIG. 2. The vacuum switches intended to be connected to one tap of a tapped transformer winding are arranged at a relatively high level, and the vacuum switches intended to be connected to another contiguous tap of a tapped transformer winding are arranged at a relatively lower level than the first mentioned vacuum switches. Thus the vacuum switches for phase U designated by the reference characters US1 and UH1 in FIG. 2 which correspond to the vacuum switches US1 and UH1 shown in FIG. 1 intended to be normally connected to tap N1 of FIG. 1 are arranged at a relatively high level. The vacuum switches for phase U designated by the reference characters US2 and UH2 in FIG. 2 which correspond to the vacuum switches US2 and UH2 shown in FIG. 1 intended to be normally connected to tap N2 of FIG. 1 are arranged at a relatively low level. It will further be noted from FIG. 2 that the pair of vacuum switches US1, UH1 are angularly displaced relative to the pair of vacuum switches US2, UH2. FIG. 2 further shows vacuum switches VS1, VS2 and VH2 pertaining to phase V of a three phase circuit, the fourth vacuum switch VH1 pertaining to phase V not being visible in FIG. 2. Of the four vacuum switches WS1, WH1, WS2, WH2 pertaining to phase W of a three phase circuit U, V, W only the vacuum switch WH1 is shown in FIG. 2 which corresponds to the vacuum switch UH1 of FIG. 1. The vacuum switches WS1, WH2 and WS2 which correspond to the vacuum switches US1, UH2 and US2 of FIG. 1 do not appear in FIG. 2. The drive shaft or operating shaft 1 for all the aforementioned vacuum switches is arranged along the axis of the cylindrical pattern formed by the vacuum switches. Shaft 1 operates the vacuum switch operating mechanism generally indicated by reference character 2 in FIG. 2 and shown in detail in FIG. 3. Operating mechanism 2 will be described below in detail in connection with FIG. 3.

As shown in FIG. 2 the aforementioned vacuum switches are supported by a pair of circular coaxial plates 3, 4 maintained in fixed spaced relation by spacer strips 5. Plates 3, 4 support on the axially outer end surfaces thereof switch-over resistors VR1, UR1, WR1 and UR2, VR2, WR2, Resistors UR1 and UR2 correspond to the resistors shown in FIG. 1 to which the same reference characters have been applied. Resistors VR1, VR2 pertain to phase V and are connected in the same fashion as the resistors UR1, UR2 pertaining to phase U. Resistors WR1, WR2 pertain to phase V of a three phase circuit and are connected in the same fashion as resistors UR1, UR2 pertaining to phase U. FIG. 2 further shows the leads U1, U2 also shown in FIG. 1 for connecting vacuum switches US1, UH1, UH2 and US2 to the taps N1, N2 of FIG. 1. The leads for the vacuum switches pertaining to phase V, W (not shown) are arranged in the same fashion as the leads U1, U2 for phase U. It will be apparent that leads U1, U2 are arranged along parallel lines and are narrowly spaced and project transversely through plate 4. As mentioned before, the two vacuum switches UH2, US2 and the two vacuum switches UH1, US1 pertaining to the same phase U are angularly displaced, the axis of angular displacement being shaft 1. This applies also to the vacuum switches of phases V and W. This displacement allows the passage in parallel pairs through plate 4 of the leads to all vacuum switches as shown in FIG. 2 as to leads U1, U2. The aforementioned arrangement of leads is also conducive to a desirable voltage distribution inside of the transfer switch and is made possible because there is normally no difference in potential between leads U1, U2 on account of the fact that both contacts K1, K2 of FIG. 1 normally engage the same tap N1 or N2, respectively. The angle between immediately adjacent vacuum switches may be referred-to as angular pitch, and the angular displacement of columns US1, UH1 and US2, UH2 is equal to that angular pitch. The leads V1, V2 and W1, W2 (not shown in FIG. 2) are angularly displaced 120° relative to each other and relative to leads U1, U2. FIG. 2 further shows the lead Y also shown in FIG. 1 connected to a pair of conductor rings 11, 12 arranged adjacent the axially inner ends of the vacuum switches forming part of the transfer switch. As shown in FIG. 2 conductor rings 11, 12 are arranged in coaxial relation and at different levels and form the neutral of a Y connected electric polyphase system.

In FIG. 2 reference numerals 101, 102 have been applied to indicate electrical connectors for establishing the circuitry of FIG. 1. Reference numeral 103 has been applied to indicate flexible conductors between conductive operating rods 61, 71, 62, 72 for the movable contacts of vacuum switches US1, UH2, UH1, US2 operated by the aforementioned operating rods. These rods are, in turn, conductively connected to the movable contacts of the vacuum switches which are operated by them. FIG. 2 shows but the flexible connections between annular conductor 12 and operating rods 62, 72, while similar flexible connections between annular conductor 11 and operating rods 61, 71 do not appear in FIG. 2. As mentioned above, annular conductors 11, 12 may form the neutral point of a Y connected polyphase system. As shown in FIG. 2 annular conductors 11, 12 are conductively connected to line Y which extends transversely through base plate 4.

The operating rods 61, 62, 71, 72 for the vacuum switches of the transfer switch are arranged parallel to drive shaft 1 and movable in a direction longitudinally thereof. The operating rods are arranged in coaxial pairs such as 61, 62 and 71, 72 and these pairs are tied together by the mechanisms such as 8, 9 shown in detail in FIG. 4. As shown in FIG. 4 helical clamping springs 37 are interposed between the axially inner ends of rods 61, 62 and between the axially inner ends of rods 71, 72.

In FIG. 4 and FIGS. 6A–6H reference characters 38, 38′, 39 and 39′ have been applied to indicate helical springs for transmitting movements of operating plate 10 in a direction longitudinally of shaft 1 to operating rods 61, 62 and 71, 72. Operating plate 10 is positively fixedly secured to spring housing parts 8 and 9 in FIGS. 2 and 4 so that parts 8 and 9 are moved jointly upwardly and downwardly with operating plate 10. Part 8 is provided with an upper flange 81 against which spring 38 abuts and a lower flange 82, and plate 40 is interposed between the lower end of spring 38 and flange 82 (see also FIG. 6A). In like fashion part 9 is provided with an upper flange 91 and a lower flange 92. Spring 38′ rests with its lower end against flange 92 and the upper end of spring 38′ rests against plate 40′. Reference numerals 41, 42 have been applied to indicate a pair of discs arranged inside of part 8 and fixedly spaced by spacers 50. In like fashion a pair of discs 41′, 42′ is arranged inside of part 9 and fixedly spaced by spacers 50′. The ends of springs 39 rest against discs 40 and 42 and the ends of springs 39′ rest against discs 40′ and 42′ (see also FIG. 6A). The juxtaposed axially inner ends of rods 61 and 62 are of increased diameter. These portions receive the axially outer ends of the aforementioned damping spring 37 and form abutments cooperating with discs 41, 42. Rods 71, 72 have juxtaposed axially inner ends of increased diameter. These ends of portions of increased diameter receive the axially outer ends of a damping spring 37 and form abutments cooperating with discs 41′, 42′.

Figure 6A:
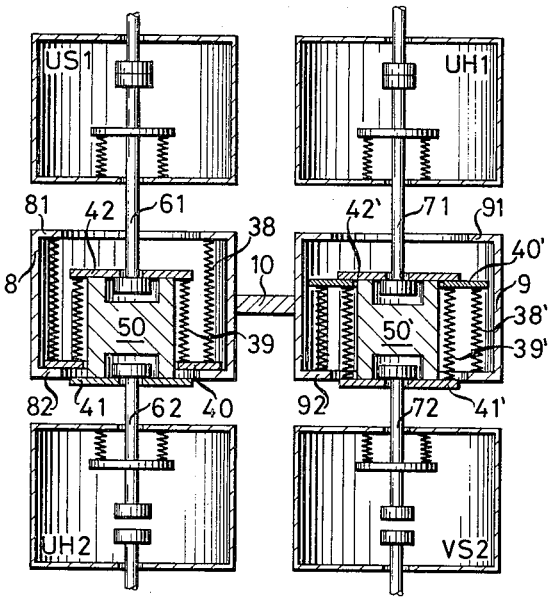
FIGS. 6A to 6H show diagrammatically the opening operation and the closing operation of two juxtaposed vacuum switches forming part of the structure of FIG. 2, these vacuum switches serving as main contacts and as auxiliary contacts, or switch-over contacts, in the structure of FIG. 2.

Assuming that operating plate or driving element 10 is moved in downward direction as seen in FIGS. 4 and 6A. As a result member 8 is moved in downward direction and flange 81 thereof moves the upper end of spring 38 in downward direction. Disc 40 supported by flange 82 and under the action of spring 38 is likewise moved downwardly. This motion of parts 10 and 8 is initially a lost motion inasmuch as it has no effect upon operating rods 61, 62. When disc 40 engages, or abuts against, disc 41 the motion of disc 40 is transmitted to operating rod 62 by the intermediary of the unit 41, 50, 42. As shown in FIG. 6A there is a small clearance between the enlarged axially inner ends of operating rods 61, 62 and discs 42, 41. Upon a joint motion of parts 41, 50, 62 equal to that clearance operating rods 61, 62 are moved in downward direction.

Referring now to the right part of FIG. 4, when operating disc 10 is moved in downward direction, the member 9 is likewise moved in downward direction since parts 9 and 10 are fixedly tied together. The flange 91 of tie member 9 performs a lost motion before the motion of tie member 9 has any effect upon operating rods 71, 72. This lost motion of tie member 9 comes to an end when flange 91 thereof abuts against part 40′. In order to achieve the required sequence of operations, the lost motion between parts 91 and 40′ exceeds the lost motion between parts 40 and 41 shown in the left portion of FIG. 4. During the lost motion between parts 91 and 40′ spring 38′ is allowed to exapnd. After the flange 91 of the member 9 engages disc 40′ and carries the latter with it, spring 39 is compressed. As a result of the compression of spring 39 disc 41′ is moved in downward direction. Since discs 41′ and 42′ are fixedly tied together by spacers 50′, disc 42′ follows the movement of disc 41′. There is a clearance between the enlarged ends 73, 74 of operating rods 71, 72 and as a consequence of that clearance rods 71, 72 are operated only upon movement of unit 41′, 50′, 49′ a distance equal to said clearance.

FIGS. 6A–6H show in sequence the steps involved in operating rods 61, 62 and 71, 72 by tie members 8, 9 and operating disc 10 and the lost motions involved in operating the rods 61, 62 and 71, 72.

The current-carrying contacts UD1, UD2 shown in FIG. 1 are not shown in FIG. 2, their presence being optional rather than mandatory. If the presence of such contacts is desired in the structure of FIG. 2, they may readily be arranged in the space between shaft 1 and the upper vacuum switches or the lower vacuum switches. As an alternative, current-carrying contacts such as the contacts, UD1, UD2, may be arranged at the axially outer surfaces of plates 3 and 4 adjacent the switch-over resistors present at this location.

Referring now to FIG. 3 showing the operating mechanism for rods 61, 62, 71, 72, reference characters 13 and 14 have been applied to indicate a pair of substantially cylindrical cams affixed to shaft 1 and jointly pivotable with shaft 1. A pair of spaced rings 15 and 16 is arranged in coaxial relation to shaft 1. Rings 15 and 16, are spring biased by helical compression springs 17 surrounding spring-supporting rods 18. Thus rings 15, 16 spring-supporting rods 18 and compression springs 17 form a squirrel-cage-like structure of which some parts are broken away in FIG. 3. Each ring 15, 16 has two supports 19 and 20 affixed to it. FIG. 3 showing but one of the two supports 19, the other being hidden behind a plate 23. Each of supports 19 forms a bearing for a roller 21, and each of supports 20 forms a bearing for a roller 22. Rollers 21 engage cam 13, and rollers 22 engage cam 14. Therefore, when shaft 1 and cams 13, 14 are jointly pivoted, rollers 21, 22 and their supports 19, 20 as well as rings 15, 16 may be moved in a direction longitudinally of shaft 1.

The structure of FIG. 3 further includes a top disc or end plate 23 and a bottom disc or end plate 24 both slidably mounted on shaft 1 and tied together by a plurality of tie rods 25. Discs 23, 24 and tie rods 25 are a rigid squirrel-cage-like structure forming a housing for a driving mechanism which is arranged inside of it. The abover referred-to drive disc 10 is affixed to the rods 25 and arranged about midway between the ends of rods 25. Drive disc 10 operates the aforementioned tie members 8 and 9 for operating rods 61, 62; 71, 72 as set forth above. Drive disc 10 is slidably mounted on guide rods 26 of which one is shown to the left and another to the right of FIG. 3. Preferably the structure includes 3 guide rods 26 which are angularly displaced 120°.

Discs or end plates 23 and 24 forming part of the aforementioned squirrel-cage-like housing for the driving mechanism are each provided with two supports 27, 28 forming bearings for rollers 29 and 30, respectively. The supports 27, 28 on discs 23, 24 are arranged inside of supports 19, 20 on rings 15 and 16 in such a way that rollers 21, 29 and 22, 30 are approximately juxtapposed but arranged along different radii. Each of rollers 29 and 30 may engage a locking disc 31 and 32, respectively. Locking discs 31 and 32 are tied to cams 13, 14 and form integral units with said cams 13, 14. Each locking disc 31, 32 is provided with cut-outs or recesses 33, 34, 35. The axially outer end surfaces of cylindrical cam bodies 13, 14 and the axially inner end surfaces of locking discs 31, 32 are coplanar.

It will be apparent from the above that rotation of shaft 1 in the direction of the arrow of FIG. 3, i.e. in clockwise direction, results in a rotary motion of cams 13 and 14. During that rotary motion roller 29 shown in the upper left portion of FIG. 3 rolls along the upper surface of locking disc 31 and roller 21 is pushed downwardly by the action of cam 13. This downward motion of roller 21 results in compression of helical springs 17. When roller 29 arrives at the location of slot 33 in locking disc 31, springs 17 are again free to expand and expand. As a result of the fact that roller 29 looses its support by locking plate 31 when roller 29 is free to drop through slot 33 in that plate, the structural unit 23, 24, 25 including drive disc 10 is driven by expanding spring 17 in donward direction as soon as roller 29 drops into slot 33.

Referring now to the structure shown in the lower portion of FIG. 3, as the above rotary motion of shaft 1, cams 13, 14 and locking discs 31, 32 progresses in clockwise direction, the cut-out or slot 35 in locking disc 32 moves into registry with roller 30. As a result, roller 30 may drop into cut-out or slot 35 in locking disc 35 when springs 17 expand and the unitary structure 23, 24, 25, 10 is moved in downward direction.

Assuming now that the rotary motion of shaft 1 is either continued in clockwise direction, or that the direction of the rotary motion of shaft 1 is reversed, i.e. that shaft 1 is now caused to perform a rotary motion in counterclockwise direction. Then roller 30 moves along the axially outer end surface of locking disc 32 and roller 22 is moved in upward direction by the slanting surfaces of cam 14. This, in turn, results in re-loading of helical springs 17. During that pivotal motion a cut-out 322 in locking disc 32 is moved into registry with roller 30, as a result of which helical energy storage springs 17 are again free to expand, and do expand.

Figure 5A:
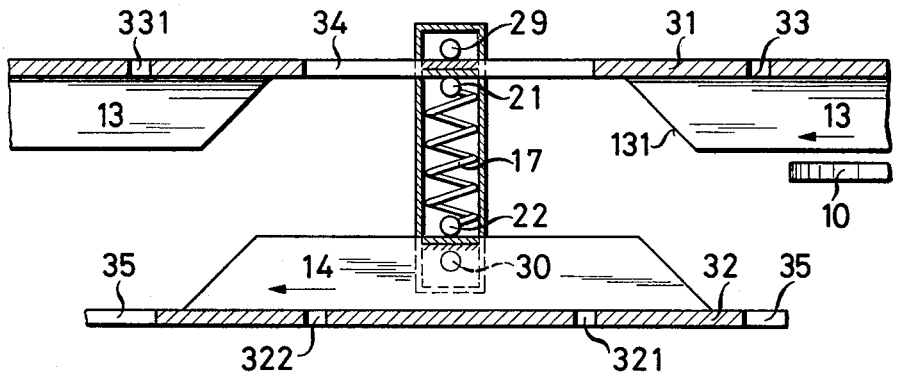
FIGS. 5A to 5E show diagrammatically five successive phases involved in an operation of the spring operated driving mechanism of a load transfer switch embodying the present invention.

As shown in FIG. 5A, pairs of cut-outs 33, 332 and 331,321 are arranged in locking discs 31, 32 to allow, irrespective of the direction of pivotal motion, expansion of energy storage springs 17 before the intermediate position between the two end portions of the structure of FIG. 3 is reached. The operation of the structure of FIG. 3 is diagrammatically illustrated in FIGS. 5A to 5E. In these figures the positions of rollers 29 and 30, respectively, correspond to the position of driving disc 10, also shown in FIGS. 5A – 5E.

Figure 5B:
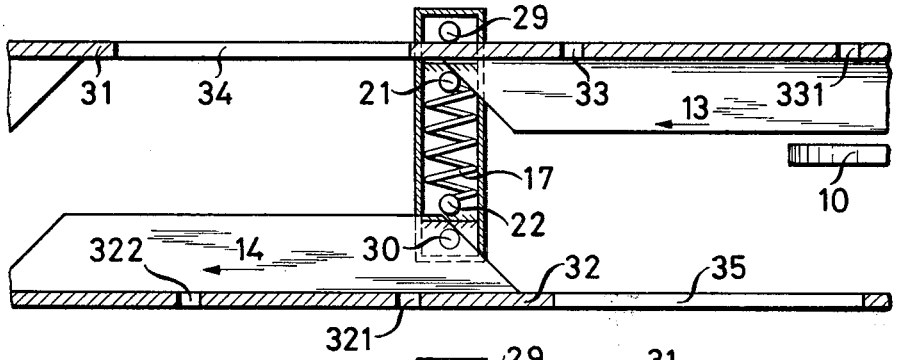
Figure 5C:
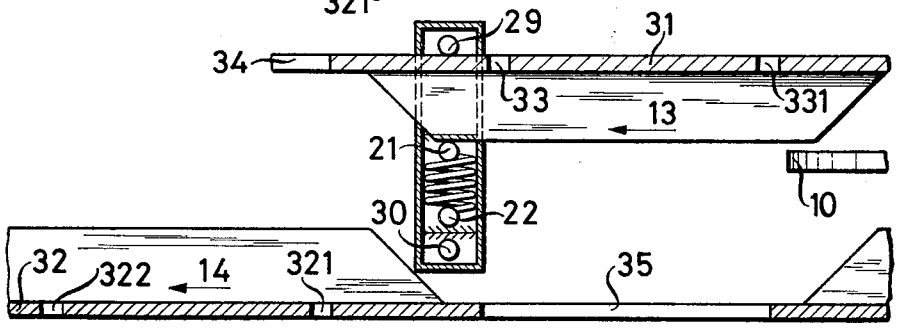
Figure 5D:
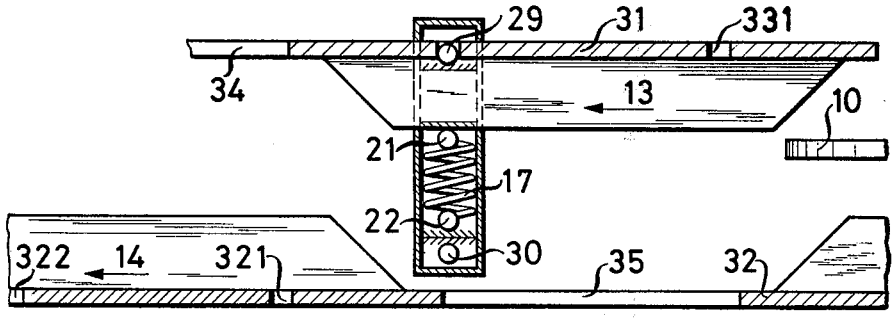
Figure 5E:
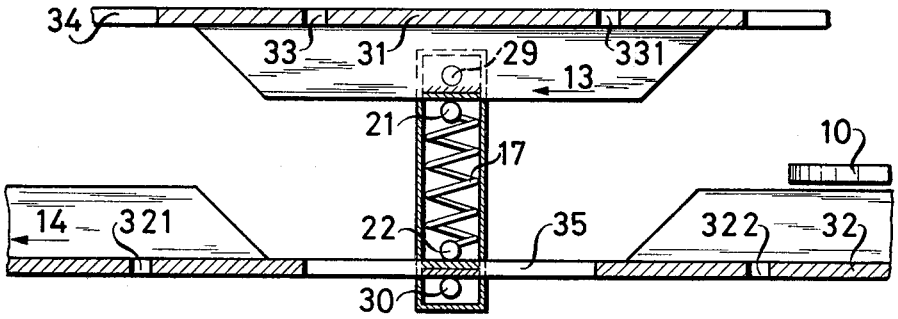

FIG. 5A shows diagrammatically the mechanism of FIG. 3 in one of its two limit positions. When shaft 1 is pivoted clockwise as indicated by an arrow in FIG. 3, the upper locking disc 31 moves under the roller 29 of top disc 23 and maintains the latter in position. Thereafter the slanting surface 131 of cam 13 (see also FIG. 3) engages roller 21 and pushes the same in downward direction. This position of the constituent parts of the mechanism is shown in FIGS. 5B and 5e. The downward motion of roller 21 results in compression of the compression springs 17 shown in FIG. 3, and diagrammatically represented in FIGS. 5A–5E by a single spring 17. The squirrel-cage-like structure 23, 24, 25, 10 (of which only part 10 has been shown in FIGS. 5A–5E) remains stationary, i.e. it does not follow the downward movement of roller 21 and ring 15 since it is retained by roller 29 which rolls along locking disc 31. Only when the position of roller 29 registers with the cut-out of slit 33 in locking disc 31 — which position of parts is shown in FIG. 5D — is it possible for compressed spring or springs 17 to expand again. When spring or springs 17 expand again, the squirrel-cage-like structure 23, 24, 25, 10 is moved downwardly and so is drive disc 10 since it is a part of that structure. As explained above, the drive disc 10 operates the aforementioned various vacuum switches which form part of the transfer switch embodying this invention. The spring-operating mechanism of FIGS. 5A – 5E then moves from the position of FIG. 5D to that of FIG. 5.5 and is then ready for the next tap-changing operation.

FIGS. 6A–6H illustrate the sequence of steps involved in the operation of pairs of vacuum switches UH1, US1 and UH2, US2, respectively. The vacuum switch VS2 corresponds to the vacuum switch US2 of phase U as far as timing of its operation is concerned.

Figure 6C:
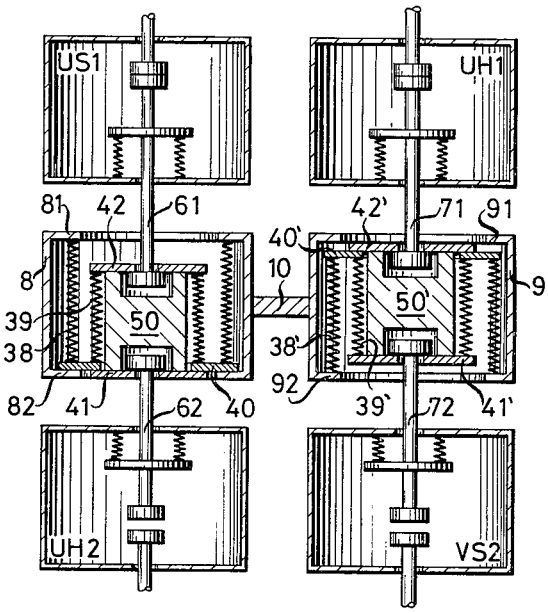
Figure 6B:
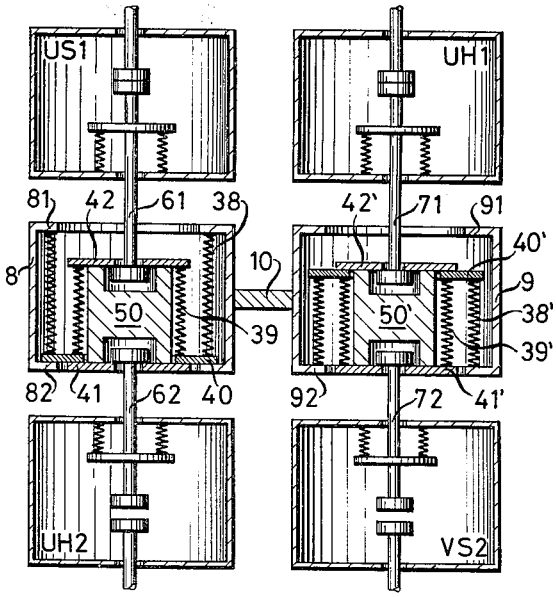
Figure 6D:
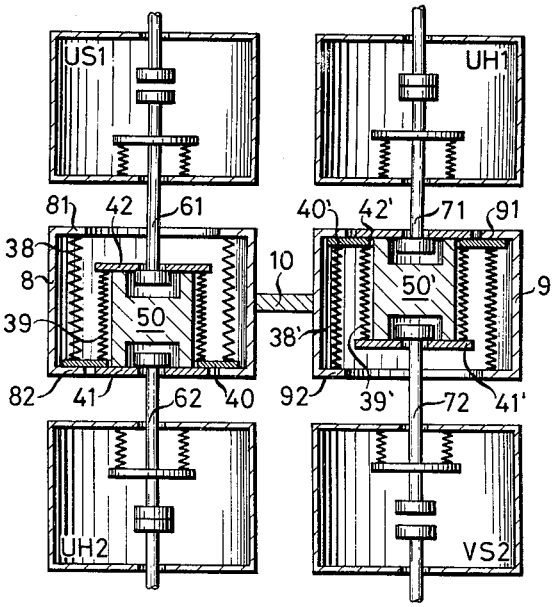
Figure 6E:
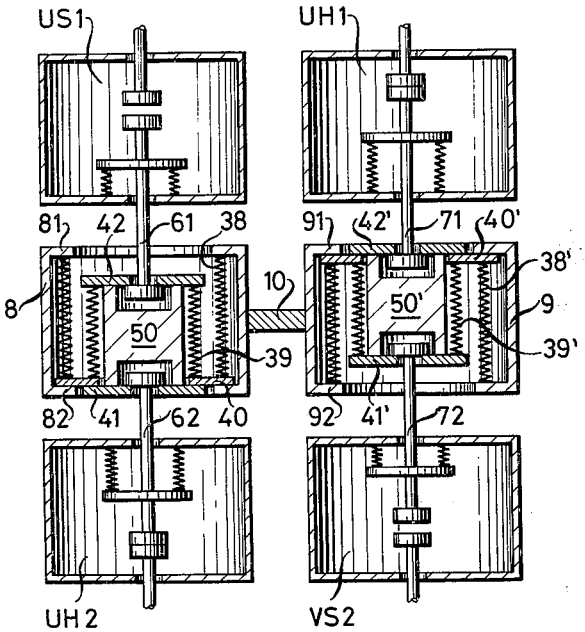
Figure 6G:
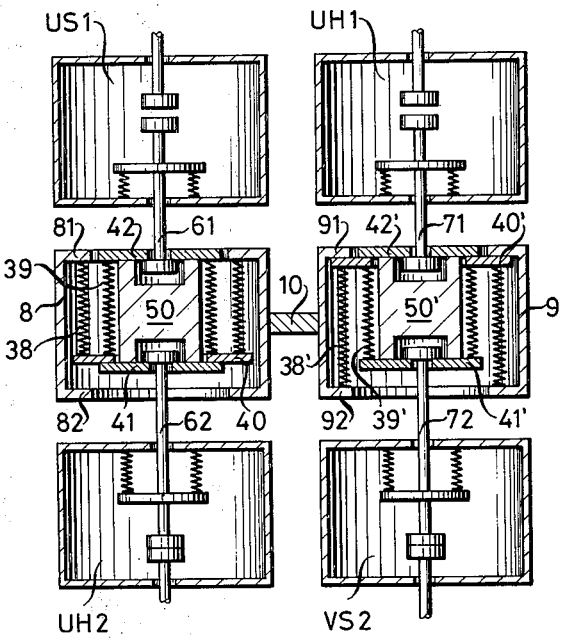
Figure 6F:
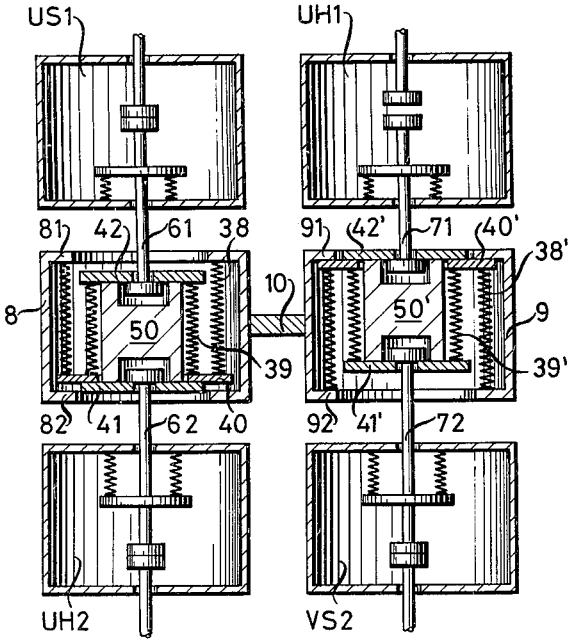
Figure 6H:
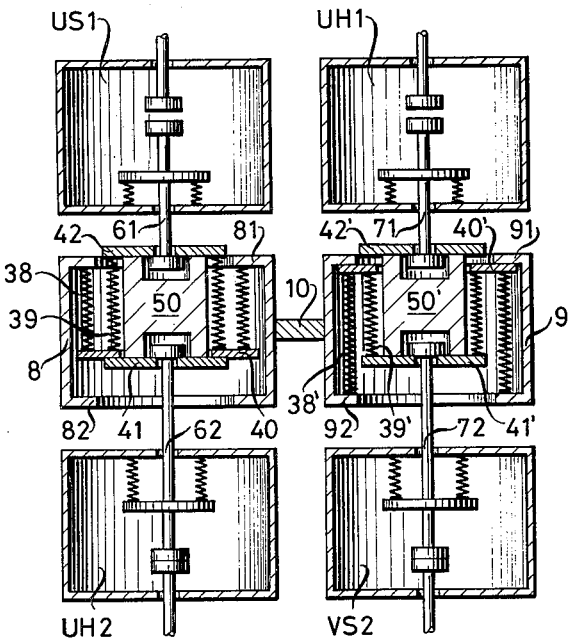

FIG. 6A shows a stationary position of the transfer switch in which vacuum switches UH1 and US1 are closed, and vacuum switches UH2, VS2 are open. It is apparent from FIG. 6A that tie means 8 and 9, respectively, have lost motions of different extent, or degree, for operating rods 61, 62 and 71, 72, respectively. FIG. 6B shows the position of tie means 8 and rods 61, 62 upon completion of the lost motion of that structure, i.e. when the gap between parts 40 and 41 has become zero and part 40 abuts against part 41. FIGS. 6C and 6D show how, as a result of continued downward motion of parts 10 and 8, the contacts of vacuum switch US1 driven by rod 61 begin to part and the contacts of vacuum switch UH2 driven by rod 62 are gradually brought into engagement. FIG. 6D shows the position of parts when the contacts of vacuum switch US1 have fully parted and the contacts of vacuum switch UH2 are fully engaged. FIG. 6D further shows the relative position of tie means 9 when the latter has just completed its lost motion relative to the operating rods 71, 72 of vacuum switches UH1, VS2. As is apparent from the above description of tie means 9, of the parts which go into it and the operation thereof, the lost motion of this structure comes to an end when the spacing between flange 91 and part 40' is down to zero, part 40' abutting against flange 91. This specific position of parts is shown to the right of FIG. 6D. As shown in FIG. 6E the contacts of vacuum switch UH1 just begin to part and the spacing between the contacts of vacuum switch VS2 begins to decrease. According to FIG. 6F the spacing of the contacts of vacuum switch VS2 is virtually down to zero and the spacing between the contacts of vacuum switch UH1 has almost reached its maximal value. FIG. 6G shows the contacts of vacuum switches US1, UH2, UH1 and VS2 virtually in their final positions upon completion of a tap-changing operation. Now the contacts of vacuum switches US1 and UH1 are fully open and the contacts of vacuum switches UH2 and VS2 are fully closed. Continued slight motion of parts 10, 8, 9 results in increasing the pressure between the engaged contacts of vacuum switches UH2 and VS2 and in the adjustment of the springs of tie devices 8, 9 so as to achieve the required degree of lost motions during a subsequent operation of the structure shown in FIGS. 6A–6H. The position of preparedness for a subsequent tap-changing operation is shown in FIG. 6H.

It will be apparent from the above, and particularly from FIG. 2, that all vacuum switches are supported by a pair of spaced parallel plates or discs 3, 4 and are arranged at two different levels in circular patterns. There are six vacuum switches at each level. The six vacuum switches at each level are arranged in pairs, each such pair encompassing a range of 120°. Four vacuum switches are provided for switching each phase of a three phase circuit, two of said four vacuum switches are arranged at a relatively high level and two of said vacuum switches are arranged at a relatively low level. The vacuum switches pertaining to one and the same phase are arranged at each level in contiguous pairs. Thus FIG. 2 shows for the phase U of a three phase circuit two contiguous vacuum switches US1 and UH1 arranged at a relatively high level and two contiguous vacuum switches US2 and UH2 arranged at a relatively low level. The pair of vacuum switches US2, UH2 arranged at the relatively low level is angularly displaced 60 degrees relative to the pair of vacuum switches US1, UH1 arranged at the relatively high level. It will be further apparent from the above that some vacuum switches pertaining to different phases are operated by the same operating tie means. Thus the vacuum switches UH1 and VS2, pertaining to different phases U and V of an electric circuit are operated by the common tie means 9.

A comparison of FIGS. 1 and 2 reveals that tie means 8 does not jointly operate vacuum switches US1 and US2, but vacuum switches US1 and UH2. In like fashion, tie means 9 does not jointly operate vacuum switches UH1 and UH2 but is a joint operating means for vacuum switches UH1 and VS2. The aforementioned angular displacement of 60° of the constituent vacuum switches arranged at two different levels is also reflected in FIGS. 6A– 6H. As far as the sequence of operating steps is concerned, whether one considers vacuum switch US2 or VS2 is immaterial.

The aforementioned angular displacement of 60° allows to arrange the lines U1, U2 of FIG. 1 parallel and close to each other as shown in FIG. 2, provided that there is no difference in potential between said lines during the stationary operation of the system. This can readily be achieved as explained in connection with FIG. 1 by moving both contacts K1, K2 into engagement with the same tap — i.e. either tap N1 or tap N2 — following completion of a tap-changing operation.

It will further be apparent from the above that a three phase transfer switch embodying this invention includes 12 vacuum switches US1, UH1, UH2, US2; VS1, VH1, VH2, VS2; WS1, WH1, WH2, WS2. The 12 vacuum switches are arranged in two groups of six at two different levels. The upper level includes vacuum switches US1, UH1; Vs1, VHl; WS1, WH1; of which vacuum switches VH1 and WS1 are hidden from sight in FIG. 2. The lower level includes vacuum switches US2, UH2; VS2, VH2; WS2, WH2; of which vacuum switches WS2 and WH2 are hidden from sight in FIG. 2. The constituent vacuum switches of each said two groups of vacuum switches are arranged in circular patterns. Juxtaposed pairs of vacuum switches such as, for instance, US1 and UH2, or UH1 and VS2, are operated by pairs of aligned operating rods 61, 62 and 71, 72, respectively. These pairs of operating rods are movable by a common drive mechanism which includes the annular driving element 10. As a result of the provision of said common drive means for all vacuum switches the latter would be operated synchroneously unless there are means for imparting the proper sequence of operation to the constituent vacuum switches of the transfer switch. These means are formed by the lost motion connection means 8, 9 interposed between annular driving element 10 and operating rods 61, 62; 71, 72. The preferred common drive mechanism shown in FIG. 3 includes drive shaft 1 arranged along an axis defined by the centers of the aforementioned groups of vacuum switches arranged at different levels and a plurality of helical compression springs 17 arranged generally in a cylindrical surface surrounding drive shaft 1. The aforementioned drive mechanism further includes cam means 13, 14 and abutment means 31, 32, both jointly pivotable with drive shaft 1 for loading springs 17 in response to predetermined angular motions of shaft 1 and allowing spring 17 to expand upon angular motions of shaft 1 in excess of said predetermined motions thereof. Annular member 10 is operated by springs 17 and operates the lost motion connection tie means 8, 9. The cam means are formed by a pair of axially spaced substantially cylindrical cam bodies 13, 14 having slanting surfaces 131 for controlling rollers 21, 22 and axially outer end surfaces. The aforementioned abutment means are formed by a pair of plates 31, 32 arranged on said axially outer end surfaces of cam bodies 13, 14 and having peripheral cutouts 33, 34, 35. Springs 17 are positioned by a squirrel-cage-like structure including a plurality of guide rods 18 each arranaged inside one of springs 17. This squirrel-cage-like structure includes the spring-compressing end members 15, 16 provided with roller means 21, 22 under the control of cam means 13, 14. Annular driving element 10 forms part of an additional squirrel-cage-like structure provided with roller means 29, 30 engaging, and under the control of, plates 31, 32. The aforementioned lost motion connection means include a plurality of housings affixed to annular driving element 10 and each located between juxtaposed pairs of vacuum switches arranged at different levels as, for instance, the pair of vacuum switchs US1, UH2, or the pair of vacuum switches UH1, VS1. Reference numerals 8 and 9 have been applied to indicate the aforementioned housings as such as well as these housings plus the lost motion connection parts contained therein. As shown in FIGS. 4 and 6A–6H each housing 8, 9 houses abutment means for operating rods 61, 62; 71, 72 which abutment means are formed by discs 41, 42; 41′, 42′ spacers 50, 50′ integrating one bottom disc 41, 41′ and one top disc 42, 42′ into a structural unit 41, 50, 42 and 41′, 50′, 42′ respectively. The units 41, 50, 42 and 41′, 50′, 42′, respectively, operate rods 61, 62 and 71, 72 respectively in response to movements of annular driving element 10 in the direction of drive shaft 1. Housings 8 contain annular spring supports 40 and housings 9 contain annular springs supports 40'. Spring support 40 supports two of the ends of a pair of coaxial helical springs 38, 39 arranged in housings 8. The other end of spring 38 rests against flange 81 of housing 8 and the other end of spring 39 rests against disc 42 and abutment means 41, 50, 42. In like fashion spring support 49' in housing 9 supports two ends of a pair of coaxial helical springs 38', 39' arranged in that housing. The other end of spring 38' rests against flange 41' of housing 9 and the other end of spring 39' rests against disc 41' of abutment means 41', 50', 42'.

While FIG. 2 shows but a pair of parallel contiguous conductors U1, U2 projecting transversely through base plate 4, it will be apparent from the fact that this is a three phase transfer switch, that the switch includes a total of three such pairs of parallel contiguous conductors angularly displaced about 120° which project transversely through base plate 4.

It will be noted from FIG. 2 that one of conductor rings 11 forming the neutral point of a Y connected three phase system is arranged in a plane situated between the higher level vacuum switches US1, UH1, etc., and last motion connection means 8, 9, while the other of conductor rings 12 forming the neutral point of a Y connected three phase system is arranged in a plane situated between the lower level vacuum switches UH2, US2, etc. and lost motion connection means 8, 9. Rings 11, 12 which are conductively interconnected by conductor Y are an extremely simple means for establishing a neutral point in a transfer switch of the kind under consideration.

We claim as our invention:

1. A three phase transfer switch for tapped regulating transformers including a. 12 vacuum switches forming two groups each of six situated at two different levels, the constituent vacuum switches of each said groups being arranged in circular coaxial patterns and the vacuum switches on one of said levels being arranged in registry with the vacuum switches on the other of said levels;

b. pairs of aligned operating rods movable in a direction longitudinally thereof arranged between registering pairs of vacuum switches at different levels for operating said pairs of vacuum switches at different levels;

c. a drive mechanism having a common power driven driving element for said pairs of operating rods movable in the direction of the axis of said circular coaxial patterns, said drive mechanism including a drive shaft arranged along an axis defined by the centers of said two groups of vacuum switches;

d. lost motion connection means interposed between said driving element and said pairs of aligned operating rods to impart a predetermined sequence to the operation of said vacuum switches;

e. a plurality of helical compression springs extending parallel to said drive shaft and arranged generally in a cylindrical surface surrounding said drive shaft;

f. cam means and abutment means both jointly pivotable with said drive shaft for loading said plurality of helical compression springs in response to predetermined angular motions of said drive shaft and allowing said plurality of helical compression springs to expand upon angular motions of said drive shaft in excess of said predetermined angular motions thereof; and g. an annular driving element surrounding said drive shaft operated by said plurality of helical compression springs and operating said lost motion connection means.

2. A three phase transfer switch as specified in claim 1 wherein said lost motion connection means include a. a plurality of housings positively affixed to said annular driving element and each located between registering pairs of vacuum switches arranged at different levels;

b. abutment means for each of said pairs of operating rods each arranged inside one of said plurality of housings for operating one of said pairs of operating rods in response to movements of said annular driving element in the direction of said drive shaft; and c. an annular spring support and a pair of coaxial helical compression springs in each of said plurality of housings, each of said pair of coaxial helical compression springs having one end resting against said annular spring support, one of said pair of coaxial helical compression springs having an end resting against said housing and the other of said pair of coaxial compression springs having an end resting against said abutment means.

3. A three phase transfer switch as specified in claim 1 wherein a. said vacuum switches are supported by a pair of parallel plates maintained in spaced relation by spacers extending parallel to said drive shaft; and wherein b. each of said different levels includes a pair of contiguous vacuum switches for each phase jointly encompassing an angle of about 120°.

4. A three phase transfer switch as specified in claim 3 wherein a. each pair of contiguous vacuum switches for one phase on one of said different levels is angularly displaced about 60° relative to each pair of contiguous vacuum switches for the same phase on the other of said different levels; and wherein b. three pairs of contiguous substantially parallel conductors project transversely through one of said pair of parallel plates, each of said three pairs of conductors being angularly displaced about 120°.

5. A three phase transfer switch as specified in claim 1 including a pair of annular conductively interconnected conductor rings for forming the neutral point of a Y connected three phase system, one of said pair of conductor rings being arranged in a plane situated between said vacuum switches at one of said two different levels and said lost motion connection means, and the other of said pair of conductor rings being arranged in a plane situated between said vacuum switches at the other of said two different levels and said lost motion connection means.

6. A three phase transfer switch as specified in claim 1 wherein a. said cam means are formed by a pair of spaced substantially cylindrical cam bodies having slanting roller-control surfaces and axially outer end surfaces;

b. said abutment means are formed by a pair of plates arranged on said axially outer end surfaces of said substantially cylindrical cam bodies and having peripheral cut-outs;

c. said plurality of helical springs are positioned by a squirrel-cage-like structure including a plurality of guide rods each arranged inside of one of said plurality of helical springs;

d. said squirrel-cage-like structure further includes spring compressing end members provided with roller means under the control of said cam means; and e. said annular driving element forms part of an additional squirrel-cage-like structure provided with roller means under the control of said pair of plates arranged on said axially outer end surfaces of said pair of substantially cylindrical cam bodies.

* * * * *